United States Patent [19]

Blaseck et al.

[11] Patent Number: 4,609,323

[45] Date of Patent: Sep. 2, 1986

[54] REMOTELY-CONTROLLED REMOTE HANDLING ARRANGEMENT FOR A LARGE-AREA CELL OF A NUCLEAR FACILITY

[75] Inventors: Klaus Blaseck, Burgdorf; Lothar Hoffmeister, Hanover, both of Fed. Rep. of Germany

[73] Assignee: Deutsche Gesellschaft für Wiederaufarbeitung von Kernbrennstoffen mbH, Hanover, Fed. Rep. of Germany

[21] Appl. No.: 663,443

[22] Filed: Oct. 22, 1984

[30] Foreign Application Priority Data

Oct. 25, 1983 [DE] Fed. Rep. of Germany ..... 3338687

[51] Int. Cl.[4] ..... B66C 19/02

[52] U.S. Cl. ..... 414/663; 212/175; 212/210; 212/213

[58] Field of Search ..... 414/146, 662, 663, 672; 212/128, 129, 175, 179, 205, 210, 213, 221

[56] References Cited

U.S. PATENT DOCUMENTS 3,810,551 5/1974 Bust et al. ..... 212/128 X

*Primary Examiner*—Robert G. Sheridan

*Attorney, Agent, or Firm*—Walter Ottesen

[57] ABSTRACT

The invention is directed to a remotely-controlled remote handling arrangement for use in large-area radioactively-charged cells of a facility for reprocessing irradiated nuclear fuel materials. The remote handling means includes a travelling bridge crane and a manipulator carrying apparatus arranged in a plane below the bridge beam of the crane. To improve the self servicing and internal maintenance thereof, the arrangement is made up of various assemblies. The movable assemblies can be separated from their travelling chassis frames. The drive units for driving the chassis frames stay with assemblies when the latter are removed. Accordingly, chassis frames are left on the bridge beam or guide member without their drive units.

6 Claims, 5 Drawing Figures

REMOTELY-CONTROLLED REMOTE HANDLING ARRANGEMENT FOR A LARGE-AREA CELL OF A NUCLEAR FACILITY

FIELD OF THE INVENTION

The invention relates to a remotely-controlled remote handling arrangement for a large-area, radioactively-charged processing cell of a facility for reprocessing irradiated nuclear fuel materials. The arrangement includes a remotely-controlled bridge crane mounted beneath the ceiling of the cell. The bridge crane has a bridge beam movable in a horizontal plane through the cell above the process components of the processing cell and equipment such as manipulator carrying apparatus is supported on the bridge beam.

BACKGROUND OF THE INVENTION

Facilities for the reprocessing of irradiated nuclear fuel materials are equipped with so-called hot cells for holding the components needed for conducting the industrial processes associated therewith. In these radiation-shielded cells, the process components are arranged in scaffold-like structures or racks as they are sometimes referred to.

The maintenance work within the hot cell affected by radioactive radiation should be conducted preferably without the necessity of operating personnel entering the hot cell. It has therefore been suggested to conduct the maintenance work by means of remotely-controlled equipment which can be movable within the hot cell. For this purpose, it is desirable that the racks holding the components used in the industrial processes be arranged in mutually adjacent rows longitudinally along the walls of the hot cell. In this way, a center passageway is formed along which the remotely-controlled equipment for the maintenance work can be moved and for exchanging the individual process components or exchanging fully-loaded racks.

For the maintenance work and the exchange of individual process components or of entire racks, a combination of remotely-controlled machines for performing manual-like operations are utilized. The control room for the remotely-controlled overhead bridge crane is located underneath the ceiling and above the racks. The overhead bridge crane passes over both rows of racks and the center passageway. After all connections and conduits are disconnected, the racks or heavy individual components are lifted from their anchor locations with the aid of the overhead bridge crane. The bridge crane then moves the racks or individual components horizontally into the transport passageway.

In addition to the overhead bridge crane, a manipulator carrier apparatus is provided which can act in the horizontal direction from the central transport passageway to engage the process components and to position operating devices, maintenance devices and tools. This manipulator carrier apparatus opens up the possibility for utilizing electrical servo and power manipulators as well as providing the capability for the future use of robots and programmed apparatus. Manual-like operations are performed on small components with the available manipulators and lifting devices in dependence upon the configuration of the manipulator carrier apparatus.

The manipulator carrying apparatus is a crane-like arrangement and includes a vertical column mounted movably on a bridge beam. The manipulator carrying apparatus is arranged for movement along the large-area cell under the bridge crane. There is a vertically movable running frame on the column with an extendable arm which has a tool carrying plate for supporting or connecting tools or manipulating devices.

A division of work can be obtained with a bridge crane and a manipulator carrying apparatus. The remote controlled bridge crane is used predominantly for holding and transporting conduit connections, components and individual racks. It could be utilized for lowering and holding tools such as separating means and welding means. The manipulator carrying apparatus is adapted to travel along the transporting passage and guides impact wrenches or other special tools which may be required as additional aids for performing assembly or disassembly tasks. The apparatus can further be used to support television equipment or other auxiliary devices.

A remotely operable remote handling arrangement is disclosed in published German patent application DE-OS No. 33 13 663 and the possibility of self-maintenance of the manipulator carrying apparatus and of the bridge crane thereabove are emphasized as an important advantage. The bridge beam of the manipulator carrying apparatus is in the form of a single girder box type bridge. Together with the movable frame, which is mounted on the column and forms a support, and the rotary spindles linking support and column and linking support and pivoting extendable arm, the pivoting extendable arm mounted on the support eccentrically to the column can be pivoted past both sides of the bridge girder by means of a flange connected powered manipulator. The pivoting extendable arm thus reaches equipment above the bridge beam of the manipulator carrying apparatus. In addition, the single beam bridge forms no obstacle to the interplay of the manipulator carrying apparatus and the travelling bridge crane when processing equipment is transported.

SUMMARY OF THE INVENTION

It is an object of the invention to configure the remote handling arrangement described above so as to improve the self servicing and internal maintenance thereof.

The remotely-controlled remote handling arrangement of the invention is for use in a large-area, radioactively-charged processing cell of a facility for reprocessing irradiated nuclear fuel materials. The arrangement includes a remotely-controlled bridge crane mounted beneath the ceiling of the cell, the bridge crane including a bridge beam movable in a horizontal plane through the cell above the process components of the processing cell; a plurality of individual movable system assemblies; a plurality of travelling chassis frames movably mounted on the bridge beam and corresponding to respective ones of the system assemblies for supporting and transporting the latter on and along the beam; a plurality of engaging means for detachably mounting the assemblies to the chassis frames corresponding thereto; and, each of the movable system assemblies including drive means for driving the chassis frame corresponding to the assembly along the beam, the drive means being arranged on the assembly so as to be mounted on and separated from the chassis frame when the assembly is mounted on and detached from the latter.

Since the remote handling means is operated under the chemical and radiation conditions prevailing in the large cell, it has to be serviced under conditions appropriate to remote handling.

The remote handling arrangement of the invention is therefore modularized and divided into few assemblies containing all the drives and measurement transmitters which can then be completely exchanged when there is a malfunction. This reduces the required number of locations whereat separation by remote handling is required when an assembly is exchanged in the processing cell. When a system assembly is taken out, the drive means for the travelling chassis frame of that assembly is always automatically taken out and exchanged with it, while the chassis frame is left behind. This mechanical coupling location can at the same time be the separating point for the supply of electricity and the like.

According to the invention, the manipulator carrying apparatus is made up of only a small number of assemblies which can be interchanged individually. The extendable arm mounted on a travelling chassis frame for movement along the guide column can be uncoupled from that chassis frame. The drive unit for this chassis frame is fixed to the extendable arm.

The guide column assembly can be uncoupled from its travelling chassis frame together with the drive unit for driving this chassis frame in the longitudinal direction along the bridge beam.

The tackle assembly which can move over the bridge beam of the manipulator carrying apparatus can be removed together with the drive unit for its travelling chassis frame thereby leaving the chassis frame on the bridge beam. The tackle assemblies of the crane are also attached to the drives for driving the chassis frames thereof. Accordingly, when the tackle assemblies are exchanged, the chassis frames are left on the crane without any drive units.

The vertical guide column of the manipulator carrying apparatus is mounted on a travelling chassis frame beneath the bridge beam. The drive for the travelling chassis frame and the drive for the column rotating mechanism are integrated within the column and can be exchanged together therewith. When the column has been removed, only the chassis frame is left on the bridge beam without any drive units, sets of gears or the like. The life of the chassis frame is substantially longer than that of its drive unit and it can therefore stay on the bridge beam.

Apart from the advantage of having less remote handling separating points in the remote handling arrangement, an essential advantage of the invention is that the drive units, which have a shorter life, can be exchanged independently of the particular chassis frame which is driven thereby.

BRIEF DESCRIPTION OF THE DRAWING

The invention will now be described with reference to the drawing wherein.

DESCRIPTION OF THE PREFERRED EMBODIMENTS OF THE INVENTION

Figure 1:
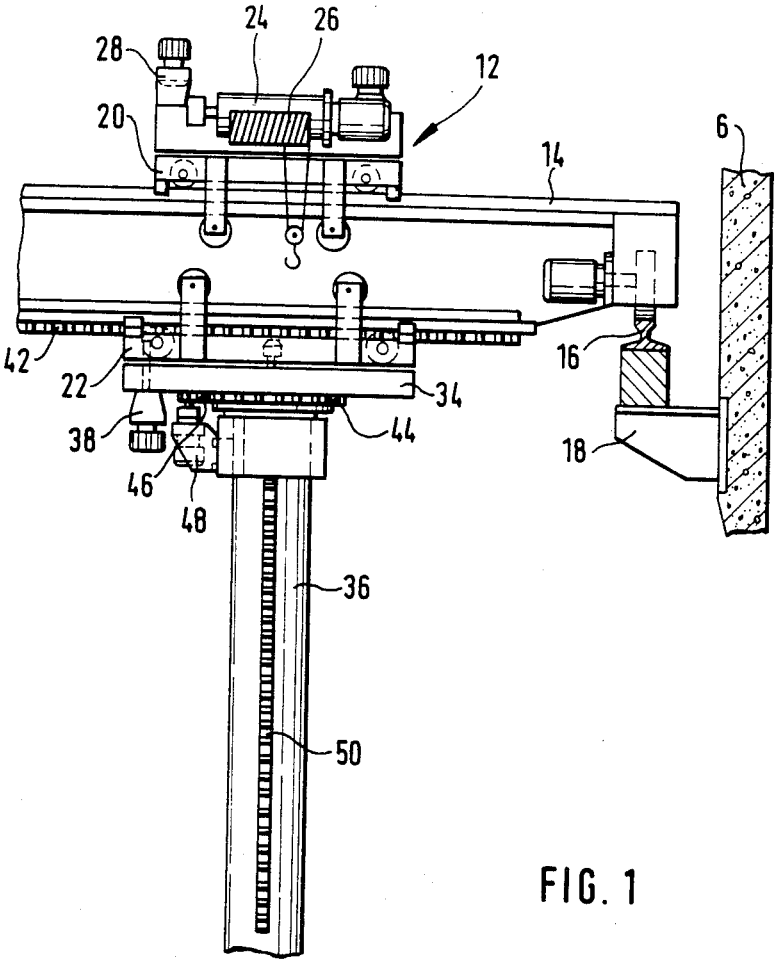
FIG. 1 shows a portion of the manipulator carrying apparatus which is movable in a direction along the longitudinal walls of the large-area cell.
Figure 2:
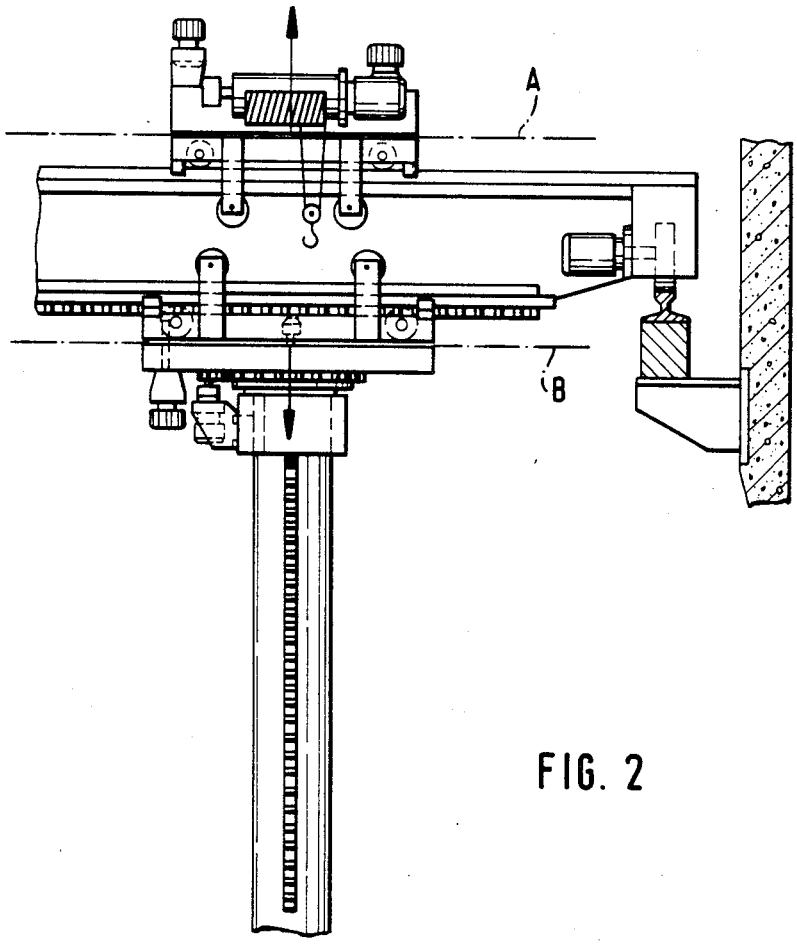
FIG. 2 shows the manipulator carrying apparatus of FIG. 1 and indicates the separating locations A and B appropriate for remote handling.
Figure 3:
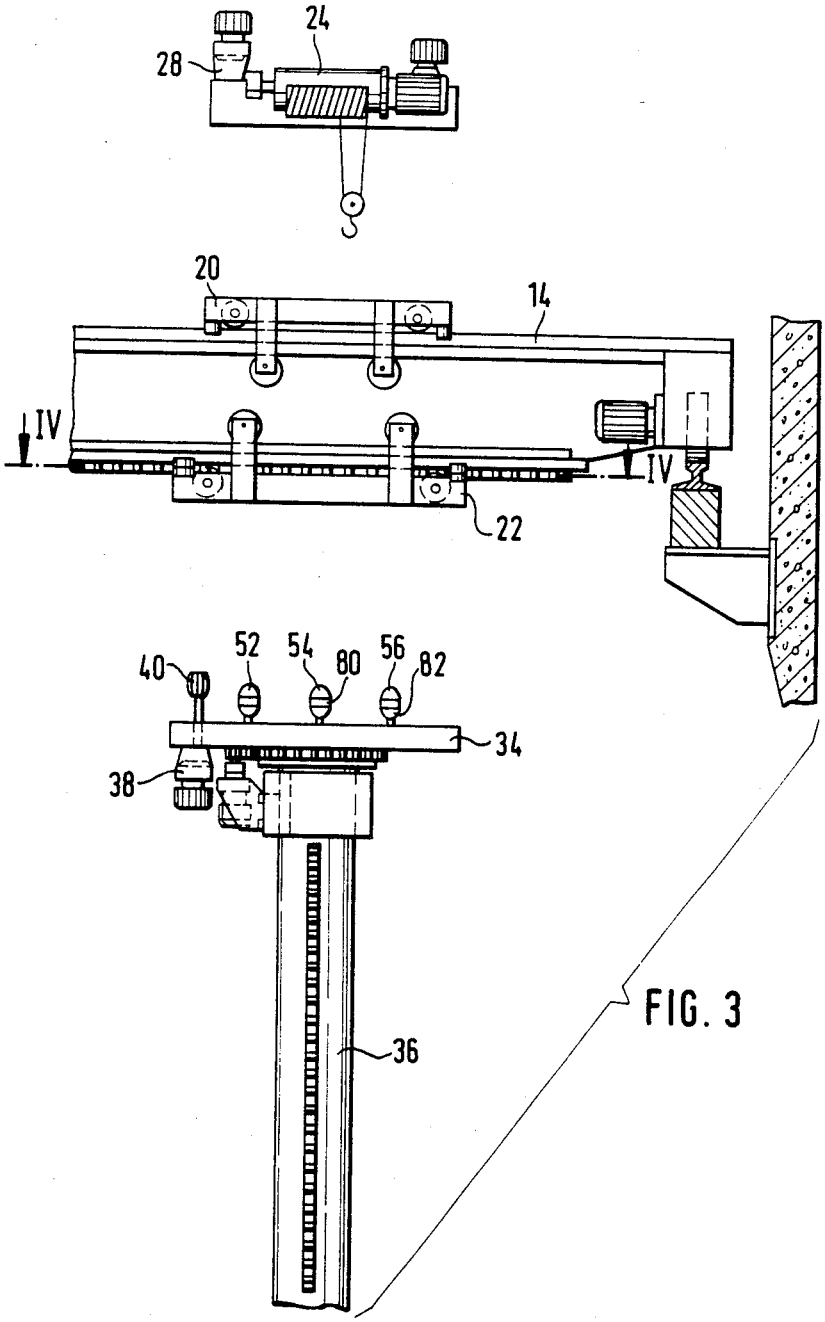
FIG. 3 shows the manipulator carrying apparatus with the various components thereof uncoupled.

Referring to FIGS. 1 to 3, only one longitudinal wall 6 of the large-area cell is shown for clarity. The manipulator carrying apparatus 12 has an upper bridge beam 14 and can be moved laterally on rails 16 arranged along the cell walls 6. The rails 16 are fixedly mounted to wall brackets 18. The manipulator carrying apparatus 12 can be moved horizontally on these rails. A travelling chassis frame 20 is movably mounted on the bridge girder 14. A travelling chassis frame 22 is movably mounted below and suspended from the bridge beam 14.

The upper travelling frame 20 carries a unit 24 with electric tackle 26. The drive unit 28 for the longitudinal movement of the frame 20 is arranged on unit 24.

Figure 5:
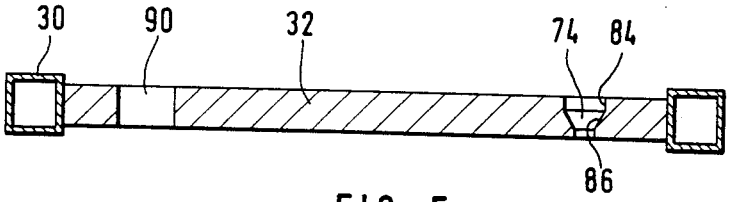
FIG. 5 is a section view taken through the base plate of the movable frame of FIG. 4 taken along the line V—V.
Figure 4:
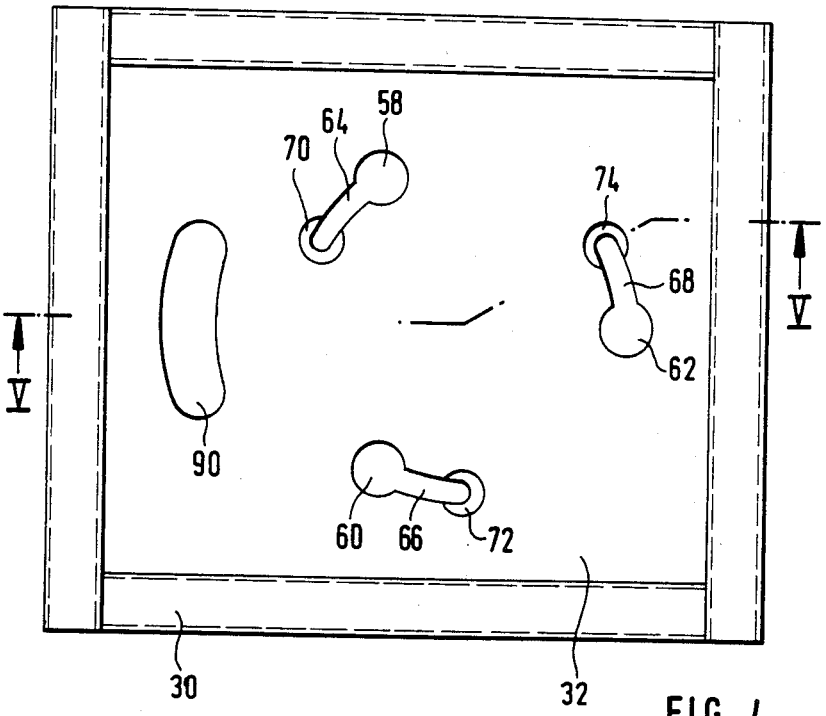
FIG. 4 is a view along the line IV—IV in FIG. 3.

The lower, suspended travelling frame 22 has a base plate 32 fixed in its frame 30 (FIGS. 4 and 5). A connecting flange plate 34 (FIG. 3) of a vertical guide column 36 is mechanically hooked into the base plate 32. The connecting flanged plate 34 of the column 36 carries a drive unit 38 with a drive pinion 40. In the coupled position illustrated in FIG. 1, the drive pinion 40 meshes with a linear gear 42 which extends parallel with the bridge beam 14 and is mounted thereon. The flanged connecting plate 34 carries a toothed rim 44 at its underside. A pinion 46 of a drive unit 48 mounted on the guide column 36 meshes with the rim 44 and drives the column 36 to rotate the same relative to plate 34, the column being rotatably mounted in the plate 34.

The guide column 36 is provided with a vertical linear gear 50 over which a travelling chassis frame (not shown) can travel up and down the column.

Three form-fit bolts 52, 54, 56 for providing a form-fit connection of the flanged connecting plate 34 to the base plate 32 of the frame 30 are provided on the plate 34 (FIG. 3). The form-fit bolts 52, 54, 56 fit with a clearance through corresponding apertures 58, 60, 62 (FIGS. 4 and 5) in the base plate 32 of the frame 30. Each aperture is connected by a short arcuate guide slot 64, 66, 68, to an arresting or latching bore 70, 72, 74 which is conically countersunk. The upper part of each conically countersunk bore 70, 72, 74 has a countersunk bore defining a cylindrical step 84 formed therein. The form-fit bolts 52, 54, 56 have respective conical surfaces 82 and, in the coupled condition, they lie with these surfaces in contact engagement with corresponding ones of countersunk conical portions 86 of the latching bores 70, 72, 74. The lower portion of the cylindrical mid portion 80 of the bolts 52, 54, 56 lies in the step 84 of the countersunk bores.

The base plate 32 contains a slot 90 through which the pinion 40 projects to mesh with the linear gear 42 when the apparatus is in the coupled condition.

The operation of the remote handling arrangement described above will be explained below.

If the guide column 36 of the manipulator carrying apparatus 12 has to be exchanged or dismantled for internal maintenance, it is lifted slightly by means of the travelling bridge crane (not shown) and rotated to release it from the form-tight connection. When the form-tight connecting bolts 52, 54, 56 are located over the pass-through bores 58, 60, 62, the guide column 36 is lowered and thus comes out of engagement with the travelling chassis frame 22 corresponding thereto. The guide column 36 can be then transported to the service area for maintenance. When the column 36 is disengaged, the drive 38 of the travelling frame 22 is necessarily taken out therewith. When a new column 36 is introduced, a new drive 38 for the travelling frame 22 is perforce brought in therewith.

An exchange of the column 36 simultaneously leads to an exchange of the drive unit 38 of the travelling chassis frame 22 without any special additional measures or remote controlled operations.

A considerable amount of time is saved which would otherwise have to be spent in separately dismantling the drive unit 38 in the processing cell and the number of remote handling locations is minimized. This further improves the conditions of use for remote handling technology.

It is understood that the foregoing description is that of the preferred embodiments of the invention and that various changes and modifications may be made thereto without departing from the spirit and scope of the invention as defined in the appended claims.

What is claimed is:

1. Remotely-controlled remote handling arrangement for use in a large-area, radioactively-charged processing cell of a facility for reprocessing irradiated nuclear fuel materials, the arrangement comprising:

a remotely-controlled bridge crane mounted beneath the ceiling of the cell; the bridge crane including a bridge beam movable in a horizontal plane through the cell and above the process components of the processing cell;

a movable manipulator carrying apparatus arranged at an elevation beneath said bridge crane, the apparatus including:

a travelling chassis frame movably mounted on said bridge beam for movement therealong;

a vertical guide column assembly adapted to carry said manipulator means thereon;

engaging means for detachably mounting said guide column assembly to said chassis frame; and, drive means for driving said chassis frame along said bridge beam, said drive means including a track formed on said bridge beam so as to extend along substantially the entire length thereof and a drive motor fixedly mounted on said guide column assembly for engaging said track when said assembly is mounted on said chassis frame whereby said drive motor is removed with said assembly when the latter is disengaged from said chassis frame.

2. The arrangement of claim 2, said guide column assembly comprising:

a connecting flange plate for interfacing with said chassis frame when said assembly is detachably mounted thereto;

a guide column rotatably mounted on said flange plate at its upper column end;

said drive means being fixedly attached to said flange plate; and, said engaging means being adapted to detachably connect said assembly to said chassis frame at said flange plate whereby said chassis frame supports and transports said guide column along said bridge beam.

3. The arrangement of claim 2, said chassis frame having a base plate; and, said engaging means comprising: a plurality of apertures formed in said base plate; and, a plurality of form-fit bolts fixedly mounted on said flange plate for hooking into corresponding ones of said apertures when said guide column assembly is detachably mounted on said chassis frame so as to permit the latter to support and transport said guide column assembly along said bridge beam.

4. Remotely-controlled remote handling arrangement for use in a large-area, radioactively-charged processing cell of a facility for reprocessing irradiated nuclear fuel materials, the arrangement comprising:

a remotely-controlled bridge crane mounted beneath the ceiling of the cell; the bridge crane including a bridge beam movable in a horizontal plane through the cell and above the process components of the processing cell;

a movable manipulator carrying apparatus arranged at an elevation beneath said bridge crane, the apparatus including:

a travelling chassis frame having a base plate and being movably mounted on said bridge beam for movement therealong;

a vertical guide column assembly adapted to carry manipulator means thereon and including a connecting flange plate for interfacing with said chassis frame when said assembly is detachably mounted thereto; and, a guide column rotatably mounted on said flange plate at its upper column end;

engaging means for detachably mounting said guide column assembly to said chassis frame, said engaging means being adapted to detachably connect said assembly to said chassis frame at said flange plate whereby said chassis frame supports and transports said guide column along said bridge beam; and, drive means for driving said chassis frame along said bridge beam, said drive means being fixedly attached to said flange plate and arranged so as to be mounted on and separated from said chassis frame when said column assembly is mounted on and detached from the latter;

said engaging means including: a plurality of apertures formed in said base plate; and, a plurality of form-fit bolts fixedly mounted on said flange plate for hooking into corresponding ones of said apertures when said guide column assembly is detachably mounted on said chassis frame so as to permit the latter to support and transport said guide column assembly along said bridge beam;

each of said apertures including; a pass-through bore for accommodating the bolt corresponding thereto; an arcuate guide slot communicating with said pass-through bore for guiding said bolt in said base plate; and, a conically countersunk arresting bore communicating with said slot for receiving and arresting said bolt therein.

5. The arrangement of claim 4, each of said bolts having a main body and a conically, inwardly tapered stem extending downwardly therefrom toward said flange plate; said main body having a cylindrical mid surface just above said tapered stem; and, each of the arresting bores having a cylindrical countersink just above the conical countersink thereof whereby the interface between the bolt and arresting bore defines a form-fit when the bolt is hooked therein.

6. Remotely-controlled remote handling arrangement for use in a large-area, radioactively-charged processing cell of a facility for reprocessing irradiated nuclear fuel materials, the arrangement comprising:

a remotely-controlled bridge crane mounted beneath the ceiling of the cell; the bridge crane including a bridge beam movable in a horizontal plane through the cell and above the process components of the processing cell;

a movable manipulator carrying apparatus arranged at an elevation beneath said bridge crane, the apparatus including:

a travelling chassis frame movably mounted on said bridge beam for movement therealong;

a vertical guide column assembly adapted to carry said manipulator means thereon;

engaging means for detachably mounting said guide column assembly to said chassis frame; and, drive means for driving said chassis frame and column assembly along said bridge beam, said drive means including a track formed on said bridge beam so as to extend along substantially the entire length thereof, and a drive motor fixedly mounted on said guide column assembly for engaging said track when said assembly is mounted on said chassis frame; and, said engaging means including latching means on said column assembly, and receiving means formed on said chassis frame for receiving said latching means therein so as to permit said column assembly to be in a first position relative to said chassis frame whereat said drive motor is out of engaging contact with said track; and, said receiving means further including detent means for receiving said latching means in a detent position after said column assembly is moved relative to said chassis frame so as to permit said drive motor to come into contact engagement with said track whereafter said drive motor can move the composite of said chassis frame and said column assembly along said track.

* * * * *

UNITED STATES PATENT AND TRADEMARK OFFICE

CERTIFICATE OF CORRECTION

PATENT NO. : 4,609,323

DATED : September 2, 1986

INVENTOR(S) : Klaus Blaseck and Lothar Hoffmeister

It is certified that error appears in the above-identified patent and that said Letters Patent is hereby corrected as shown below:

In line 11 of the Abstract: after the word "with" please add -- the --.

In column 5, line 50: delete "claim 2," and substitute -- claim 1, -- therefor.

In column 6, line 49: delete "including;" and substitute -- including: -- therefor.

Signed and Sealed this

Twenty-fifth Day of November, 1986

*Attest:*

DONALD J. QUIGG

*Attesting Officer* *Commissioner of Patents and Trademarks*